United States Patent [19]

Hockenberry et al.

[11] Patent Number: 4,671,570

[45] Date of Patent: Jun. 9, 1987

[54] STACKABLE ADJUSTABLE MUSICIAN'S CHAIR

[75] Inventors: Jack Hockenberry; Leslie R. Abraham, both of Owatonna, Minn.

[73] Assignee: Wenger Corporation, Owatonna, Minn.

[21] Appl. No.: 799,952

[22] Filed: Nov. 20, 1985

[51] Int. Cl.[4] ..... A47C 1/02

[52] U.S. Cl. ..... 297/337; 297/313; 297/459; 297/DIG. 2

[58] Field of Search ..... 29/458, 459, 337, 338, 29/313, DIG. 2, DIG. 1, 239

[56] References Cited

U.S. PATENT DOCUMENTS

| | | | |
|---|---|---|---|
| 2,221,268 | 11/1940 | Sears | 297/337 |
| 2,542,366 | 2/1951 | Scott . | |
| 2,646,839 | 7/1953 | Hillman | 297/538 X |
| 3,111,344 | 11/1963 | Hoven et al. | 297/239 |
| 3,159,428 | 12/1964 | Schier | 297/239 |
| 3,708,202 | 1/1973 | Barecki et al. | 297/239 |
| 4,403,356 | 9/1983 | Urai | 297/DIG. 1 |
| 4,506,750 | 12/1981 | Wenger et al. | 297/459 |
| 4,522,447 | 6/1985 | Snyder et al. | 297/DIG. 1 |

FOREIGN PATENT DOCUMENTS

| | | | |
|---|---|---|---|
| 2030095 | 1/1971 | Fed. Rep. of Germany | 297/313 |

OTHER PUBLICATIONS

Photograph of Wenger folding chair

*Primary Examiner*—Francis K. Zugel
*Attorney, Agent, or Firm*—Dorsey & Whitney

[57] ABSTRACT

A chair, specifically engineered and designed for musicians which in both adjustable and stackable. A highly developed human factored design which is mechanically correct has been developed. The basic framework for the seat pan and back support of the chair is specifically designed and contoured to enable a performing musicians to breathe properly while comfortably seated. Blow molded plastic is used for the seat pan having a desired amount of flexibility. The seat pan is covered by molded foam and a stretch fabric to enhance the function and comfort of the chair. This combination of materials prevents degradation of the posture configuration of the pan for the life of the chair. The backrest is similarly designed and provides upper back support rather than just a posture guide. The general plane of the chair is tiltable so that the chair can adjust to meet the needs of weight bearing instrumentalists, such as violinists, and can also be used to address the power breathing problems of wind and brass instrumentalists, such as trumpeters. The design of the tilting mechanism and the legs of the chair are such that the chairs can be stacked for storage.

4 Claims, 7 Drawing Figures

STACKABLE ADJUSTABLE MUSICIAN'S CHAIR

BACKGROUND OF THE INVENTION

The invention relates to the seating art and particularly to the seating requirements of a musician.

Good posture and comfort seating for office and recreational use has been addressed for many years. Similarly vehicle seating, automotive and aeronautical, has been studied and designed for many years. However, the performing musician because of the unique requirements of diaphragmatic breathing and the various weight and position requirements has not benefitted from the long and arduous studies until recently. U.S. Pat. No. 4,306,750, the disclosure of which is incorporated herein by reference, was the first major development to address the specific needs of the seated musician, both vocalist or instrumentalist. However, there are slight differences in seating requirements for different musicians.

For example, a violinist or other string instrumentalist must sit erect and breathe normally, but must balance the weight of the violin on his or her shoulder with the violin extending forward and to the side. Contrasted with the violinist is the instrumentalist who plays a wind instrument. These instruments must be supported in a forward direction, but the breathing of the performer must be diaphragmatic with thighs dropped to free the diaphragm. Similarly, a vocalist who holds no instrument must breathe in a manner similar to a standing vocalist. All must achieve a normal standing lordosis (Lumbar) curve while seated on the chair.

It is also clear that other enhancements were possible to the invention of the aforementioned patent. These include the comfort of the seating, a better back support and overall design of the chair to make it stackable and thus easily stored when there are no musicians sitting on a stage.

SUMMARY OF THE INVENTION

The instant invention adopts the advantages and design features of U.S. Pat. No. 4,306,750 and enhances the advantages of that patent by adding selected features which add to the utility and comfort of the specific needs of various performing musicians.

The contoured seat of the previous patent had different planes for the thighs and pelvis of the performing musician which rotated the pelvis forward so that diaphragmatic breathing could be attained. The instant invention retains the relationship of the thighs to the pelvis but further enhances this relationship by allowing the overall slope of the seat to be selectively tilted. Thus a trumpet player can slant more forward in his chair to assure proper diaphragmatic breathing, while the violinist can slant back slightly to support the weight of the violin which the violinist must play. Tilting of the chair is from the forward end of the chair as opposed to conventional seating which often times permits a chair to tilt back. While a backward tilting chair has advantages in the office and recreational environment it is not suitable for the performing musician.

Additional enhancements in the human factored design relate to function and comfort of the chair. These features are achieved with the specific construction of the improved musician's chair. The seat pan is created of blow molded plastic having flexibility and yield where needed and yet rigidity in the important areas of the planes required for musician seating. The seat pan is covered by molded foam having varied thickness to enhance the comfort of the chair. The density and load deflection of the foam is also carefully selected to achieve the required comfort. Covering the foam is a woven stretch fabric which presents an extremely suitable upholstered chair for use by the seated musician which does not degrade over time.

The backrest of the chair is similarly constructed with a lumbar ridge to provide a functional upper back support component and not just a posture guide. The seat tilt mechanism is positioned with this in mind so that the back support remains constant regardless of the tilt of the chair.

The seat tilt mechanism is also specifically designed in conjunction with the support or legs of the chair so that the tilt mechanism is adjustable while seated in the chair and which lies flat in the plane of the bottom of the seat so that the chair can be conveniently stacked on other chairs for storage.

It is, therefore, an object of this invention to permit proper diaphragmatic breathing and comfort of various performing musicians.

It is a similar object of the invention to permit adjustment of a musician's chair in a manner beneficial to the playing of a specific instrument while being played by a seated musician.

It is another object of the invention to enhance the comfort of the seated musician.

It is an object of the invention to provide upper back support. It is a similar object to integrate the back support of the chair with the other enhancements and advantages of the musician's chair.

It is another object of the invention to provide a musician's chair which can be stored in a stacked relationship one to the other.

Another object of the invention is to provide long term seat and back contouring that will retain its shape after many years of use.

These and other objects and advantages of the present invention will become apparent from a consideration of the following description in connection with the drawings.

DESCRIPTION OF THE PREFERRED EMBODIMENT

In U.S. Pat. No. 4,306,750 entitled "Musician's Chair", a chair 12 specifically designed for a seated musician is disclosed and described. The disclosure of that patent is incorporated by reference herein. In that patent, it was pointed out that the best natural body position conducive to good musical performance is a standing posture because diaphragmatic breathing is best achieved when standing. In a normal standing posture the spinal column assumes a natural or relaxed sacro-lumbar curve. In order to achieve such a posture during seated performances, the invention of the aforementioned patent defined a relationship between the plane of the thighs 22 of the seated performer and the plane of the pelvis 24 which rotated the pelvis forward. A backrest was also included as part of the invention 12 of the prior patent to provide a posture guide to correctly position the back of the performer relative to his thighs and pelvis to enhance proper posture for diaphragmatic breathing.

However, different performers have unique needs. And, although the overall needs of a seated musician were addressed by the prior patented invention, specific changes to meet specific needs could not be changed according to that invention. For example, a trumpet or trombone player would prefer to sit more forwardly than a violinist to achieve diaphragmatic breathing while a seated violinist, who must also breathe properly, prefers less forward slope than the brass player in the chair 12 to support the weight of the violin. All musicians are able to achieve their optimum seating configuration with the adjustable features of the disclosed musician's chair 12 of the instant invention.

Figure 1:
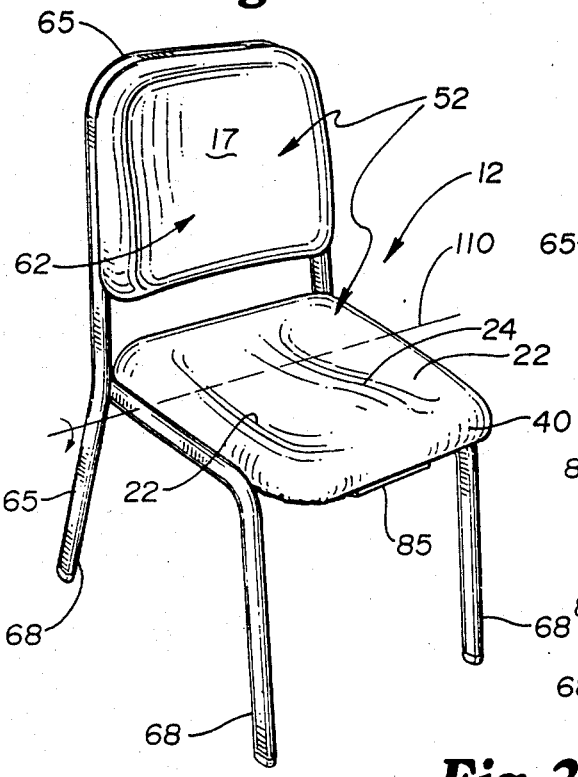
FIG. 1, is a perspective view of the chair of the present invention.

Referring to the figures, the construction and operation of the adjustable and the stackable musician's chair 12 can best be understood. As shown in FIG. 1, both the seat pan 40 and the back support 17 are contoured to achieve specific objectives of the invention. The overall contour of the seat 40 is substantially similar to that set forth in U.S. Pat. No. 4,306,750, that is, three planes 22,24 for sitting are created, one 22 for each thigh and a third plane 24 for the pelvis which bisects the thigh planes 22, the pelvis plane 24 being angled above the thigh planes 22 to rotate the pelvis forward while sitting on the chair 12.

The basic structure of the seat 40 is created with a double walled, upper and lower, blow molded plastic substrate with "standoffs" 46 interspersed throughout the chair 40 thus creating a seat 40 which is yieldable to the pressures applied to the seat 40 yet rigid where standoffs 46 occur to maintain the contouring of the seat 40. Using blow molding of the plastic, rather than injection molding, enables the wall thickness to be programmed so that weight bearing portions, such as under the ischial tuberosities, are thicker while other portions of the seat pan 43 are thinner thus enhancing flexibility where needed.

Covering and mounted on the blow molded plastic seat pan 43 is molded foam 49, such as that manufactured by Milsco, which is contoured to achieve a maximum comfort factor. That is, molded urethane with more foam 49 in the area of the buttocks then that on the area which supports the thighs 22 of the musician. The foam 49 is preferably urethane having a foam density of approximately 2.2 pounds per square foot or higher. The IFD (Indention Foam Deflection) of the foam 49 is preferably high, approximately 50 with a preferred range of approximately 40 to 50.

Overlaying and adhered to the molded foam 49 is a long wearing woven stretchable fabric 52 such as that manufactured by Gilfurd Mills, Inc. with sufficient yield to stretch with the foam deflection thus giving an upholstered appearance to the musician's chair 12. In addition, the combination of the flexibility of the blow molded seat pan 43 with the shaped molded urethane 49 and the stretchable fabric 52 which is adhered to and thus stretches with the foam deflection to avoiding the hammock effect which occurs with most covered seats, prevents breakdown of the foam 49 and consequent degradation of the posture configuration for the life of the chair 12.

The back support 17 is similarly structured to provide a lumbar ridge 62 in the area of the small of the back of a musician therefore, providing an upper back support and not just a posture guide, which greatly enhances the natural or relaxed sacro-lumbar curve of the spine while sitting. The angle of the backrest 17 to the seat is preferably about 10° to complete the back support. For cellists who lean forward a lumbar pad (not shown) can be added to the backrest 17, with a lumbar ridge and contoured to curve of the seat back 17, which is preferably strapped to the backrest 17 for adjustability and held with velcro in the straps behind the backrest 17.

The support for the chair 12 is oval tubing 65 in conventional configuration. The legs 68 are splayed or spread approximately 3° in an outward direction to allow stacking of the chairs 12 when not in use. In addition, the oval tubing 65 is structured so that the widest dimension is parallel to the sides of the chair 12 and top of the backrest 17. This permits the use of 16 gage steel for the chair support with sufficient rigidity to support forward and rearward movement, the most common movement. In addition, the oval tubing conforms to the contour of the top and sides of the backrest 17 so that it does not obstruct or hook the musician's instrument. The front legs are not cross supported to each other or to the rear legs and are sloped forward at an angle of 10° to 15°, with 10° the preferred angle. This allows a musician to hook his foot behind one of the legs 68, a common practice, but the leg is not so far forward to interfere with someone passing the chair 12. The rear legs are sloped backward at an angle greater than the backrest, approximately 15°. This prevents the backrest 17 from contacting the walls. The seat pan 43 is further cross supported by two round bars 71,72 which are used to implement the tilting function.

The forward or rearward tilt of the planes 22,24 of the chair 12 are achieved by actuation of two cam mechanisms 81,82 which are interconnected by a blade handle 85 which provides leverage for the adjustment. The rearward portion 86 of the seat pan 43 is supported on the frame by machine screws 91 which penetrate the rearward hollow crossbar 71 of the frame. The machine screws 91 are then fastened into the seat pan 43 of the chair 12 by internally threaded metal inserts 94 which are internally molded into the blow molded seat pan 43. Flexibility of the blow molded seat 43 permits pivoting about these rear attachment points 94.

The front of the seat pan 87 is also similarly attached through the forward crossbar 72 of the support frame by machine screws 92 which are threadedly inserted into mating internally threaded metal connectors 95 which are internally molded as part of the molded seat. Compression springs 102 bias the seat pan 43 in a downward position with the springs 102 extending between the heads of the machine screws 92 and the upper internal surface of the support bar 72.

Also pivotally attached to the front crossbar 72 of the support frame are the two equally distantly spaced cams 81,82 which are interconnected by a flat lever 85 which can be depressed to lower the seat 40 and pulled up to raise the seat 40. As shown most clearly in FIGS. 3*a*, 3*b*, 4*a*, and 4*b*, the cams 81,82 are constructed to fit within channels 104 molded into the forward portion of the bottom of the seat pan 43. Each cam 81,82 engages the inner surface of its respective channel 104 to raise and lower the angle of the pelvis plane 24 and the thigh planes 22 on the seat 40. Both the cams 81 and seat pan 43 are preferably constructed of polyethylene which, in conjunction with the shape of the cams 81 and bias from springs 102, allows adjustment of the lever 85 while sitting on the chair 12, although materials having a similar coefficient of friction, such as ABS plastic could be used as well.

Thus, by simply changing the position of the blade handle 85, tilt on the front of the chair 87 can be varied up to three eighths of an inch to vary the angles of the seat bottom relative to the back support 17 of the chair 12 by approximately 2° and thus permit a violinist to sit more backwardly in the chair 12 for purposes of supporting the violin and to permit a trumpet player to lean slightly forward to more fully open up the diaphragm for breathing purposes. The maximum extent of tilt can be altered by varying cam dimensions "a" and "b" shown in FIG. 4.

With the use of the rear crossbar 71 positioned inwardly from the rear of the seat 40 the pivoting mechanism is operable without changing the lumbar support of the backrest 17. The backrest 17 is angled approximately 10° from vertical. The rear cross support 71 is positioned slightly inward from where the plane of the backrest 17, when compressed, insects the general plane of the seat 40. Therefore, the axis of rotation 110 is as shown in FIG. 1 and the tilt of the thighs 22 and pelvis 24, whether slanting forward or back, occurs at approximately the hip joints of the musician without varying the back support or diaphragmatic breathing of the performer. With the construction shown the adjustment can be made by the musician by sitting back in the chair to relieve thigh pressure and rotating the lever 85 to achieve the proper selected degree of tilt to the thigh planes, 22.

Figure 2:
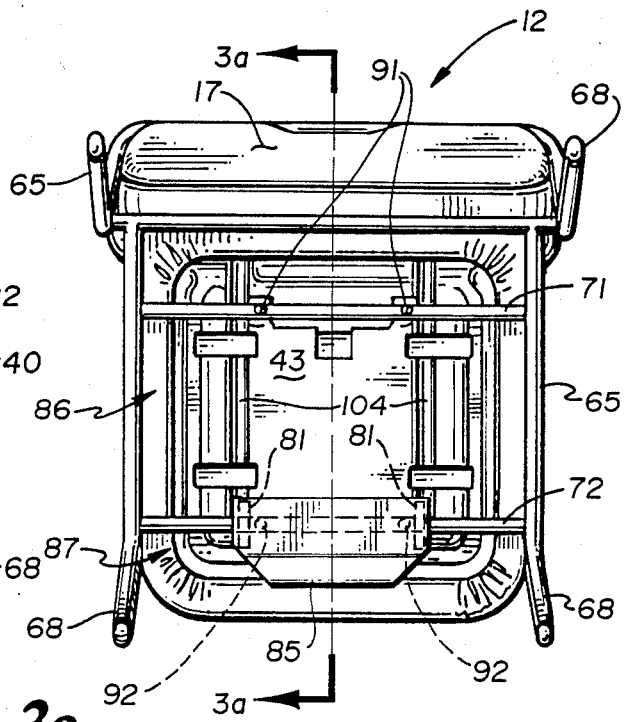
FIG. 2, is a bottom view of the chair showing the lever used for adjustment.
Figure 3A:
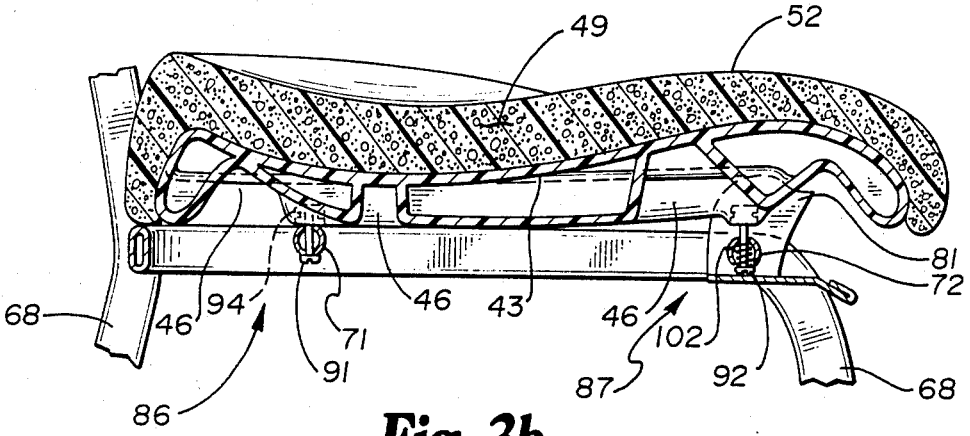
FIG. 3*a* is a sectional view taken along the line 3*a*—3*a* of FIG. 2.
Figure 3B:
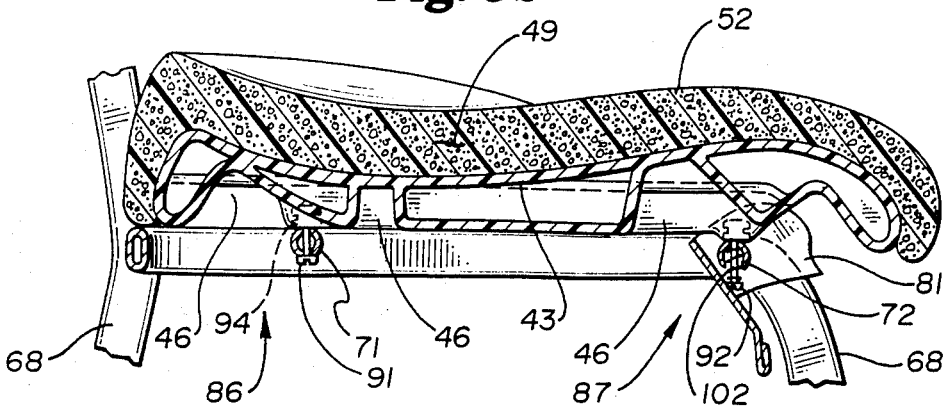
FIG. 3*b* is similar to 3*a*, but with the cam of the adjustment mechanism rotated to position the seat pan in its lowered position.
Figure 4A:
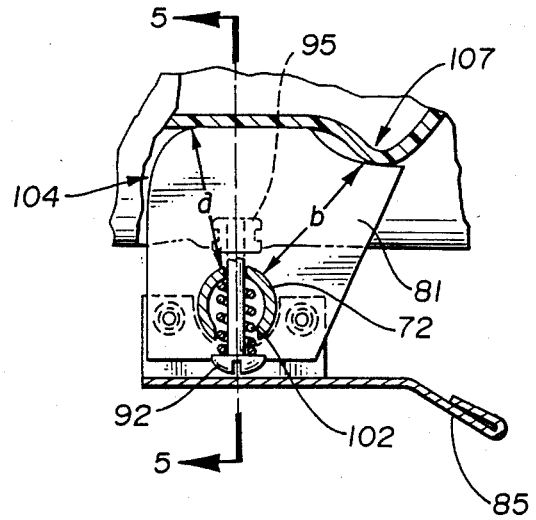
FIG. 4*a* is an exploded, fragmentary sectional view of the adjustment mechanism taken from the area indicated by arrow 4*a* in FIG. 3*a*.
Figure 4B:
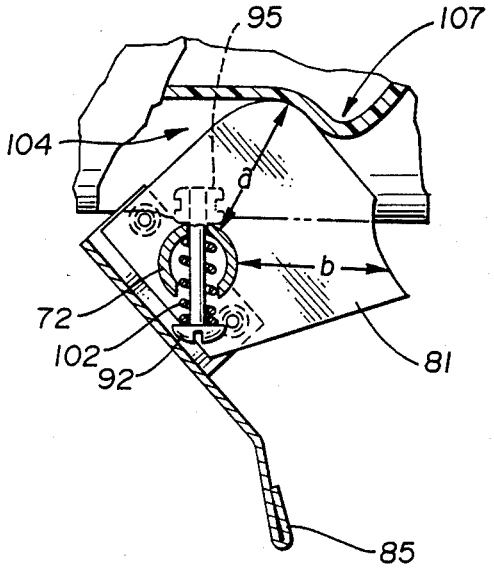
FIG. 4*b* is similar to FIG. 4*a*, but with the cam of the adjustment mechanism rotated to position the seat pan in its lowered position.
Figure 5:
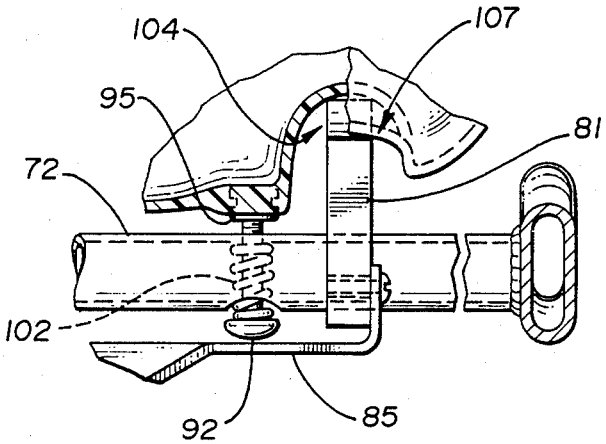
FIG. 5, is a cross-sectional view of the adjustment mechanism of FIG. 4 taken along the line 5—5 of FIG. 4.

As also demonstrated by the figures, particularly FIGS. 1 and 2, the blade handle 85 is configured to lay flat against the bottom of the seat pan 43 when rotated forwarded. In addition, each of the legs 68 to the chair are positioned on the outer most edge of the four corners of the seat 40 and angled outward so that the musician's chair 12 of the instant invention can be stacked and stored when not in use.

Having described a specific and preferred embodiment of the invention it will be obvious to those skilled in the art that other similar materials of construction and pivoting mechanisms can be used to achieve the objectives of the invention. All such modifications and variations within the intendment of the following claims.

Having described our invention, we claim:

1. A chair designed for diaphragmatic breathing, comprising:

a support frame, a flexible seat pan having a forward margin, an opposed rear margin, opposed side margins, and opposed upper and lower surfaces;

a backrest defining a backrest plane that intersects said seat pan along a backrest intersection line spaced inwardly from said seat pan rear margin;

means fixedly coupling said seat pan to said support frame along an axis of rotation oriented generally parallel to said seat pan rear margin and inwardly of said backrest intersection line;

a forward seat pan support member operably coupled to said support frame and positioned proximal said seat pan forward margin in generally face to face orientation with said seat pan lower surface;

cam means, including structure defining a first cam radius and a second cam radius, operably coupled to said support member for operable contact of said cam means with said seat pan lower surface proximal said seat pan forward margin;

actuating means operably coupled to said cam means for shifting said cam means between a first position wherein said structure defining said cam means first radius is interposed between said support member and said seat pan lower surface, and a second position wherein said structure defining said cam means second radius is interposed between said support member and said seat pan lower surface, whereby said seat pan forward margin is shiftable through a path of travel generally about said axis of rotation between raised and lowered positions; and retaining means operably coupling said support member and said seat pan for limiting said path of travel that said seat pan can be shifted through to within a predetermined range generally defined by said raised and lowered positions.

2. The invention as claimed in claim 1, said forward seat pan support member comprising a support bar oriented generally parallel to and inwardly from said seat pan forward margin said cam means comprising first and second, similarly shaped cam members pivotally mounted on and spaced apart along said support rod, said actuating means comprising a lever interconnecting said first and second cam members for mutual, sympathetic rotation of said cam members about said support bar.

3. The invention as claimed in claim 1, said retaining means including biasing means operably coupled to said support member for urging said seat pan into said lowered position.

4. The invention as claimed in claim 3, said retaining means comprising a rod shiftably received through said support bar and fixedly received within said seat pan lower surface, said rod including a lowermost enlarged head, said biasing means comprising a spring carried by said rod and extending between said lowermost head and said support bar.

* * * * *

UNITED STATES PATENT AND TRADEMARK OFFICE

CERTIFICATE OF CORRECTION

PATENT NO. : 4,671,570

DATED : June 9, 1987

INVENTOR(S) : Jack Hockenberry and Leslie R. Abraham

It is certified that error appears in the above-identified patent and that said Letters Patent is hereby corrected as shown below:

In the Abstract, delete the word "in" and substitute therefor --is--.

In the Abstract, line 7, delete the word "musicians" and substitute therefor --musician--.

Column 3, line 59, delete the word "then" and substitute therefor --than--.

Column 4, line 6, delete the word "avoiding" and substitute therefor --avoid--.

Column 5, line 34, delete the word "insects" and substitute therefor --intersects--.

Column 5, line 40, delete the word "shown" and substitute therefor --shown,--.

Column 5, line 44, delete the word "planes," and substitute therefor --planes--.

Signed and Sealed this

Second Day of February, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,671,570

DATED : June 9, 1987

INVENTOR(S) : Jack Hockenberry and Leslie R. Abraham

It is certified that error appears in the above-identified patent and that said Letters Patent is hereby corrected as shown below:

Column 5, line 48, delete the word "forwarded" and substitute therefor --forward--.

Column 5, line 59, delete the words "variations within" and substitute therefor --variations are within--.